US012429278B2

(12) United States Patent
Barros Neves et al.

(10) Patent No.: US 12,429,278 B2
(45) **Date of Patent: *Sep. 30, 2025**

(54) METHOD OF CONTROLLING OPERATION OF AN APPLIANCE

(71) Applicant: Electrolux Appliances Aktiebolag, Stockholm (SE)

(72) Inventors: Alexandre Barros Neves, Stockholm (SE); Luis Michio Kobayashi, Stockholm (SE); Anne-Kathrine Nissen, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 387 days.

This patent is subject to a terminal disclaimer.

(21) Appl. No.: 18/070,917

(22) Filed: Nov. 29, 2022

(65) Prior Publication Data

US 2023/0094292 A1 Mar. 30, 2023

Related U.S. Application Data

(63) Continuation-in-part of application No. 16/767,761, filed as application No. PCT/ET2017/080912 on Nov. 30, 2017, now Pat. No. 11,534,048.

(51) Int. Cl.

| | |
|---|---|
| ***F25D 29/00*** | (2006.01) |
| ***A47L 15/00*** | (2006.01) |
| *A47L 15/42* | (2006.01) |

(52) U.S. Cl.

CPC ..... *F25D 29/00* (2013.01); *A47L 15/0047* (2013.01); *A47L 15/4293* (2013.01); (Continued)

(58) Field of Classification Search

CPC ..... A47L 15/0047; A47L 15/4293; A47L 2401/03; F25D 29/00; F25D 2500/04; F25D 2400/361; F25D 2400/36

See application file for complete search history.

(56) References Cited

U.S. PATENT DOCUMENTS

| | | | |
|---|---|---|---|
| 8,976,126 | B2 | 3/2015 | Kim et al. |
| 10,106,924 | B2 | 10/2018 | Cruickshank et al. |

(Continued)

FOREIGN PATENT DOCUMENTS

| | | | | |
|---|---|---|---|---|
| DE | 102015220282 | A1 | 4/2017 | |
| EP | 4109020 | A1 * | 12/2022 | ..... F25D 29/00 |

(Continued)

OTHER PUBLICATIONS

European Examination for European Application No. 17 825 122.9, dated Oct. 21, 2021, 7 pages.

(Continued)

*Primary Examiner* — Benjamin L Osterhout

(74) *Attorney, Agent, or Firm* — Bradley Arant Boult Cummings LLP

(57) ABSTRACT

A method of controlling operation of an appliance, comprising: presenting at a user interface, an option to change an operating program of the appliance; operating the appliance according a selected change of the operating program; displaying, on the user interface, an indicator representing the change in the operating program; and displaying, on the user interface, separately from the displayed indicator representing the change in the operating program, a degree of ecological impact caused by the selected change of the operating program, wherein the degree of ecological impact indicates a level of resource consumption used by the appliance to operate according to the selected operating program. Also provided are appliances, such as dishwasher or refrigerators, configured to perform the method.

20 Claims, 9 Drawing Sheets

(52) U.S. Cl.
CPC ..... *A47L 2401/03* (2013.01); *F25D 2400/36* (2013.01); *F25D 2400/361* (2013.01); *F25D 2500/04* (2013.01)

(56) References Cited

U.S. PATENT DOCUMENTS

| | | | | |
|---|---|---|---|---|
| 11,534,048 | B2 * | 12/2022 | Barros Neves | A47L 15/0044 |
| 2010/0287711 | A1 | 11/2010 | Geyer et al. | |
| 2011/0175742 | A1 * | 7/2011 | Shin | F25D 29/00 700/282 |
| 2012/0056827 | A1 | 3/2012 | Kim et al. | |
| 2012/0180227 | A1 | 7/2012 | Kim et al. | |
| 2013/0067375 | A1 * | 3/2013 | Kim | G06F 3/04817 715/769 |
| 2016/0312396 | A1 | 10/2016 | Cruickshank et al. | |
| 2019/0150702 | A1 | 5/2019 | Lukschnat et al. | |

FOREIGN PATENT DOCUMENTS

| | | | |
|---|---|---|---|
| WO | 2006087735 | A1 | 8/2006 |
| WO | WO-2019105548 | A1 * | 6/2019 |

OTHER PUBLICATIONS

International Search Report and Written Opinion for International Application No. PCT/EP2017/080912, dated Jul. 26, 2018, 11 pages.

* cited by examiner

METHOD OF CONTROLLING OPERATION OF AN APPLIANCE

CROSS-REFERENCE TO RELATED APPLICATIONS

This application is a continuation-in-part of U.S. application Ser. No. 16/767,761, filed May 28, 2020, which is a national stage application filed under 35 U.S.C. § 371 of International Application No. PCT/EP2017/080912, filed Nov. 30, 2017, both of which are incorporated herein by reference in their entireties.

TECHNICAL FIELD

The invention relates to a method of controlling operation of a appliances, and appliances being controlled by the method.

BACKGROUND ART

In prior art washing appliances such as e.g. dishwashers and washing machines, a user selects a washing program via a user interface, and is presented to a resource consumption parameter, such as e.g. "time", i.e. estimated duration of the selected washing program.

US 2010/0287711 further discloses that in addition to be presented to the estimated duration of the selected washing program, the user is presented to a performance measure of the selected washing program and is allowed to adjust the performance of the selected washing program. For instance, an intensiveness measure is displayed to the user, wherein the user can increase or decrease the intensiveness of the selected program depending on how soiled the laundry to be washed is.

However, indicating measures associated with performance and resource consumption in absolute terms is a difficult task, since these measures depend on many factors some of which are unknown at the start of a washing program. Further, it is difficult for a user to evaluate these performance and resource consumption measures.

The majority of the users do not know how a washing appliance works and how each adjustable program parameter affects time, performance and consumption.

Similarly, modern-generation household refrigerators are provided with graphical interfaces configured to allow the user to select a series of operating parameters used to control the operation of the refrigerator. For example, the user can vary the temperature in the cooling chamber and/or in the freezing chamber, and/or activate cooling or rapid freezing or defrost programs, or similar functions.

It is also known that the aforementioned user setting may causes a significant ecological environmental impact associated, for example, with the electrical consumption of the refrigerator, when operating based on such conditions/setting.

Nowadays the users are aware of the refrigerator control parameters but they do not know the extent of the ecological impact caused by the commands they gives to the refrigerator.

SUMMARY

One objective of the invention is to solve, or at least mitigate, this problem in the art and to provide an improved method of controlling operation of an appliance for washing and rinsing goods via a user interface. This objective is attained in a first aspect of the invention by a method of controlling operation of a washing appliance. The method comprises displaying, on a user interface of the washing appliance, an estimated duration of a selected washing program for the washing appliance, and a degree of ecological impact caused by the selected washing program. The method further comprises allowing a user to operate the user interface to change the duration of the selected washing program, wherein the washing appliance adapts the selected cleaning program to comply with the changed duration, and displaying, on the user interface, the degree of ecological impact caused by the selected washing program when complying with the changed duration.

This objective is attained in a second aspect of the invention by a washing appliance being configured to be controlled by a user. The washing compliance comprises a user interface being configured to receive user instructions for controlling operation of the washing appliance, and a processing unit being configured to be communicatively connected to the user interface. The user interface is configured to display an estimated duration of a selected washing program for the washing appliance, display a degree of ecological impact caused by the selected washing program, indicate a level of performance and resource consumption of the selected washing program in relation to a level of performance and resource consumption of a reference washing program, and allow a user to operate the user interface to change the duration of the selected washing program. The processing unit is further configured to adapt the selected cleaning program of the washing appliance to comply with the changed duration. The user interface is further configured to display the degree of ecological impact caused by the adapted selected washing program.

With the invention, when a user selects a washing program, for instance an Eco program causing a low degree of ecological impact, this is displayed to the user e.g. on a user interface with a full ecometer to indicate to the user that an eco-friendly program is selected and the duration of the program is displayed to be relatively long, such as for example 4 hours. Now, in the invention, the user is allowed to operate the user interface to change the duration of the selected washing program, wherein the washing appliance will adapt the selected cleaning program to comply with the changed duration.

In an embodiment, the user operates the user interface—being e.g., a touch screen interface—by moving a slider in a left-hand direction, having as an effect that the duration decreases from 4 hours to, say, 2.5 hours.

At the same time, the washing appliance adapts to the change in program duration by decreasing the ecometer, thereby indicating that a shorter duration will cause the washing program to have a higher degree of ecological impact, which is displayed to the user.

For instance, in order to achieve the same degree of cleanness as in the washing program having a duration of 4 hours, the washing appliance may have to increase the energy consumption—and thus the water temperature—of the washing appliance in order to adapt to the selected shorter duration of the program.

Advantageously, this provides for clear, straightforward and simplified feedback of the impacts caused by changing the duration of the selected program, on which feedback the user is able to act to further adapt the washing program as desired. As a consequence, the user becomes more confident in adapting a washing program, and misconceptions and/or incorrect assumptions due to a lack of feedback can be avoided.

In an embodiment, the user is allowed to select a pre-set option affecting a setting of the selected washing program, such as "ExtraPower", "ExtraDrying", "Temperature", "Centrifuging", "GlassCare", "Hand Wash" etc., depending on the particular washing appliance.

In an embodiment, the degree of ecological impact is stipulated by energy and/or water consumption of the washing compliance. Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

Another aim of the present invention is therefore to provide an appliance, such as a washing appliance or refrigerator, which is configured to inform users about the ecological impact caused in response to their setting selections.

In compliance with this aim, according to another aspect of present invention there is provided a refrigerator comprising: a cabinet, which has a thermal-insulating structure and is internally provided with at least one, thermal-insulated storage cavity designed to accommodate perishable foodstuff; a user interface which is configured to allow the user to set at least a control parameter and/or an operating program to be implemented by said refrigerator, an electrically-operated cooling system which is configured to cool down the inside of said at least one storage cavity, an electronic control system which is configured to receive from said user interface said control parameter and/or said program set by the user and control the operation of said electrically-operated cooling system based on said user setting, comprising at least said control parameter and/or operating program, the electronic control system is further configured to: estimate a resource consumption at least of said electrically-operated cooling system, when it operates based on said user setting, determine a degree of ecological impact caused by said electrically-operated cooling system based on said estimated resource consumption, communicate said determined degree of ecological impact to the user by means of said user interface.

According to the present invention, the degree of ecological impact of the refrigerator is indicative of the energy consumption, e.g. electric power absorbed by at least the electrically-operated cooling system during its operating. For example, it is possible to define a plurality of levels or degrees of ecological impact associated with respective level of consumption of electrical power of the electrically-operated cooling system. That is, the higher electrical power absorbed/consumed by the electrically-operated cooling system, the greater degree of ecological impact. In other words, the degree of ecological impact is proportional to the electrical power absorbed/consumed by the electrically-operated cooling system.

Preferably, the user interface is configured to allow the user to change the temperature in said storage cavity from a first temperature to at least a second temperature, the electronic control system is configured to: estimate a resource consumption of said electrically-operated cooling system caused by the changing of temperature form said first temperature to said second temperature, determine the degree of ecological impact caused by said electrically-operated cooling system based on said estimated resource consumption associated with said temperature changing, communicate said determined degree of ecological impact to the user by means of said user interface.

Preferably, the user interface is configured to allow the user to change the operating program from a first program to at least a second program, said electronic control system is configured to: estimate a resource consumption of said electrically-operated cooling system caused by said second operating program, determine the degree of ecological impact caused by said electrically-operated cooling system based on said estimated resources consumption associated to said second program, communicate said determined degree of ecological impact to the user by means of said user interface. It is understood that each program/functions, when it is implemented by the refrigerator, causes the electrically-operated cooling system to consume a respective prefixed electric power.

Preferably, the electrically-operated cooling system comprises an electrically-operated compressor, the electronic control system is configured to estimate said resource consumption based on the electrical consumption of said electrically-operated compressor when the refrigerator operates according to said user setting, determine the degree of ecological impact based on said resources consumption associated to said electrically-operated compressor.

Preferably, the electronic control system is configured to estimate the electrical consumption of electrically-operated compressor based on the operating speed and/or the operating time of said electrically-operated compressor caused by the user setting.

Preferably, the electrically-operated cooling system comprises an electrically-operated air-blowing device, the electronic control system is configured to estimate resource consumption based on the electrical consumption of said electrically-operated air-blowing device, when the refrigerator operates according to said user setting, determine the degree of ecological impact based on said resources consumption associated to said electrically-operated air-blowing device.

Preferably the refrigerator comprises a defrost device provided with one or more electric heaters, the electronic control system is configured to estimate said resource consumption based on the electrical consumption of said electric heaters of said defrost device, when the refrigerator operates according to said user setting, determine the degree of ecological impact based on said resources consumption associated to said one or more electric heaters of the defrost device.

Preferably, the user interface comprises a display; said electronic control system is configured to display by said user interface graphic icon-segments which changes based on said determined degree of ecological impact.

The technical effect is that the refrigerator informs, i.e. warns, in real time, the user about the ecological impact caused by his settings.

The present invention further concerns to a method of operating of a refrigerator comprising a user interface, an electrically-operated cooling system and electronic control system, said method comprising allowing a user to operate said user interface to set at least a control parameter and/or select an operating program to be implemented by said refrigerator, cooling down the inside of at least a storage cavity of said refrigerator by an electrically-operated cooling system, controlling by said electronic control system the operation of said electrically-operated cooling system based on the control parameter and/or the operating program set by user; the method comprises: estimating by said electronic control system a resource consumption of at least said electrically-operated cooling system when it operates based on the user setting, determining by said electronic control system a degree of ecological impact caused by said electrically-operated cooling system based on said estimated resource consumption, communicating said determined degree of ecological impact to the user by means of said user interface.

Preferably, the method comprises: allowing a user to operate said user interface to change the temperature in said storage cavity from a first temperature to at least a second temperature, estimating by said electronic control system a resource consumption of said electrically-operated cooling system caused by the changing of temperature form said first temperature to said second temperature, determining by said electronic control system the degree of ecological impact caused by said electrically-operated cooling system based on said estimated resource consumption associated with said temperature changing, communicating by means of said user interface said determined degree of ecological impact to the user.

Preferably, the method comprises allowing the operator to operate said user interface in order to change the operating program from a first program to at least a second program, estimating by said electronic control system a resource consumption of said electrically-operated cooling system caused by said second operating program, determining by said electronic control system the degree of ecological impact caused by said electrically-operated cooling system based on said estimated resources consumption associated to said second program, communicating by means of said user interface said determined degree of ecological impact to the user.

Preferably, said electrically-operated cooling system comprises an electrically-operated compressor, the said method comprising: estimating by said electronic control system said resource consumption based on the electrical consumption of said electrically-operated compressor when the refrigerator operates according to said user setting, determining by said electronic control system the degree of ecological impact based on said resources consumption associated to said electrically-operated compressor.

Preferably, the method comprises: estimating by said electronic control system the electrical consumption of electrically-operated compressor based on the operating speed and/or the operating time of said electrically-operated compressor caused by the user setting.

Preferably, the electrically-operated cooling system comprises an electrically-operated air-blowing device, said method comprising: estimating by said by said electronic control system said resource consumption based on the electrical consumption of said electrically-operated air-blowing device, when it operates according to said user setting, determining by said electronic control system the degree of ecological impact based on said resources consumption associated to said electrically-operated air-blowing device.

Preferably, the refrigerator comprises a defrost device provided with one or more electric heaters, the method comprising: estimating by said by said electronic control system, said resource consumption based on the electrical consumption of said electric heaters of said defrost device, when the refrigerator operates according to said user setting, and determine by said by said electronic control system, the degree of ecological impact based on said resources consumption associated to said electric heaters defrost device.

Preferably said user interface comprises a display; said method comprising displaying by said user interface graphic icon-segments, which changes based on said determined degree of ecological impact.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description. In prior art washing appliances such as e.g. dishwashers and washing machines, a user selects a washing program via a user interface, and is presented to a resource consumption parameter, such as e.g. "time", i.e. estimated duration of the selected washing program.

US 2010/0287711 further discloses that in addition to be presented to the estimated duration of the selected washing program, the user is presented to a performance measure of the selected washing program and is allowed to adjust the performance of the selected washing program. For instance, an intensiveness measure is displayed to the user, wherein the user can increase or decrease the intensiveness of the selected program depending on how soiled the laundry to be washed is.

However, indicating measures associated with performance and resource consumption in absolute terms is a difficult task, since these measures depend on many factors some of which are unknown at the start of a washing program. Further, it is difficult for a user to evaluate these performance and resource consumption measures.

Figure 1:
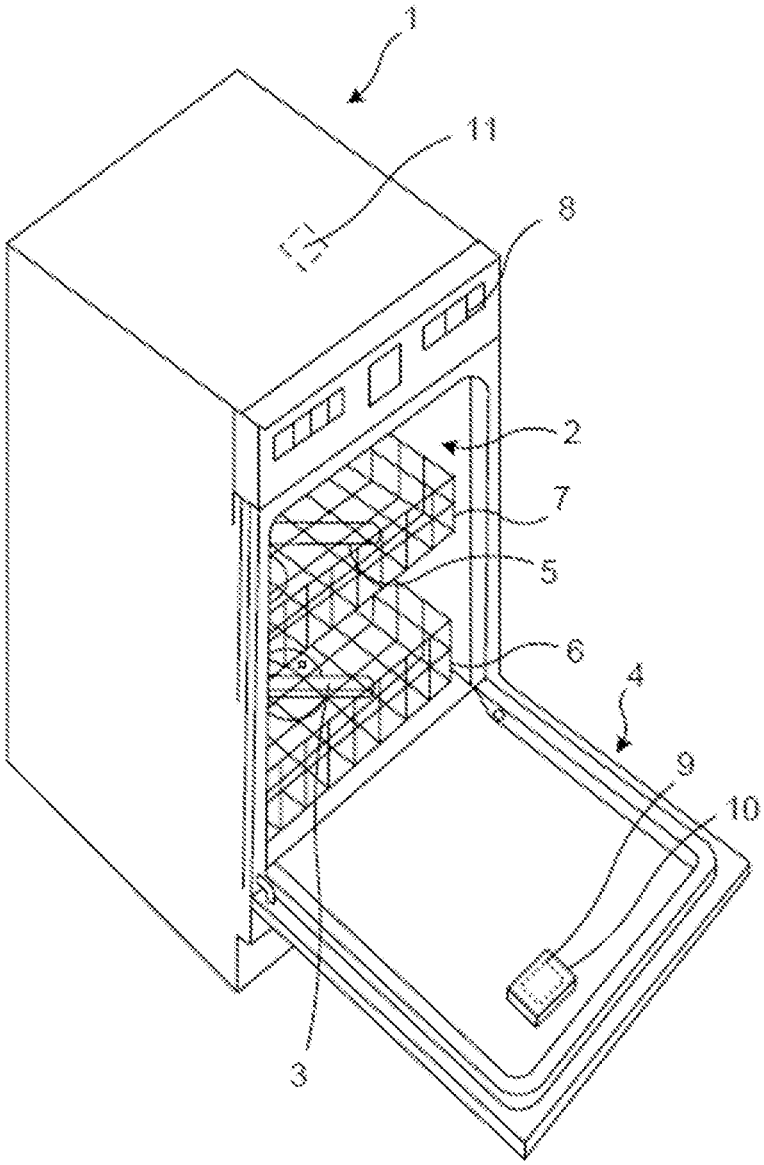
FIG. 1 shows a prior art dishwasher in which the present invention may be implemented.

FIG. 1 shows a prior art appliance for washing and rinsing goods in the form of a dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied. The present invention may further advantageously be implemented in a washing machine.

The exemplifying dishwasher 1 comprises a washing compartment or tub 2, a door 4 configured to close and seal the washing compartment 2, a spraying system having a lower wash arm 3 and an upper wash arm 5, a lower rack 6 and an upper rack 7. Additionally, it may comprise a specific top rack for cutlery (not shown). A controller 11 such as a microprocessor is arranged in the interior of the dishwasher for controlling washing programs and is communicatively connected to a user interface 8 via which a user can select washing programs. The operation of the dishwasher 1 is typically controlled by the controller 11 executing appropriate software stored in a memory.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the washing compartment 2.

FIGS. 2A through 2E illustrate a user interface 8 displaying different washing program settings depending on choices made a user.

Figure 3:
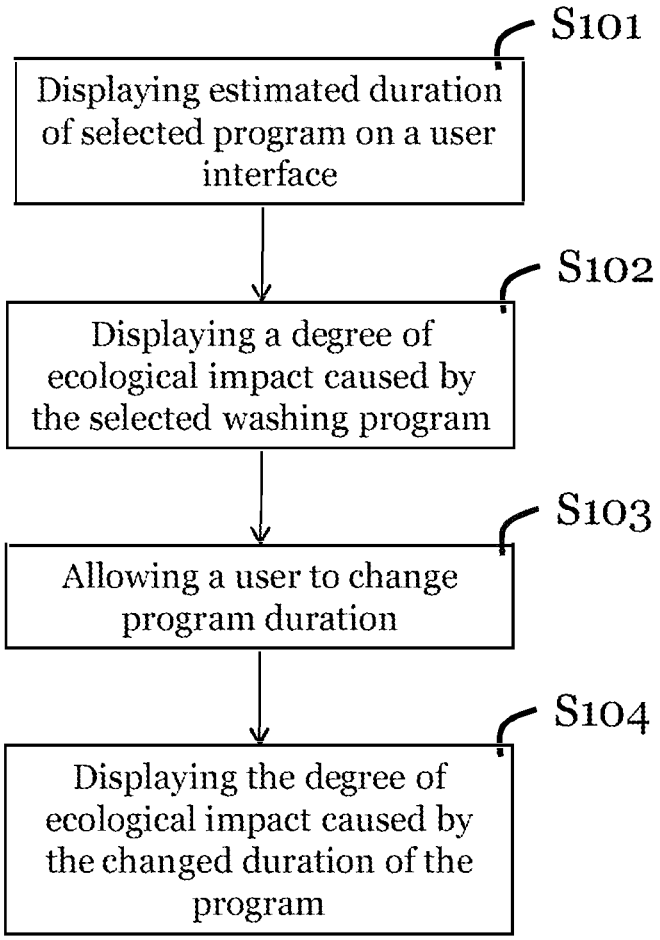
FIG. 3 illustrates a flowchart illustrating a method of controlling operation of a washing appliance according to an embodiment.

Reference will further be made to a flowchart of FIG. 3 illustrating a method of controlling operation of a washing appliance according to an embodiment.

Figure 2A:
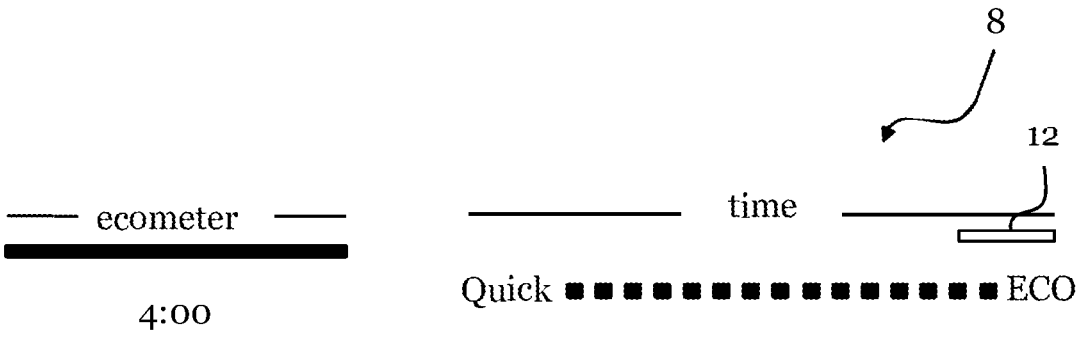
FIGS. 2A through 2E illustrate user interfaces according to embodiments showing estimated duration of a selected washing program for a washing appliance, and degree of ecological impact caused by the selected washing program.

Starting with FIG. 2A; on a right-hand side of the user interface 8 a time scale ranging from "ECO" (being a lengthy program) to "Quick" (being a short program) is displayed. In this particular exemplifying embodiment, the user interface 8—being a touch-sensitive interface—comprises a slider 12 that the user can operate and thus slide to the right to increase the program duration, or to the left to decrease the program duration.

It is noted that the user interface 8 may be a combination of a touch-screen interface and a mechanical interface comprising e.g. press-buttons and revolvable knobs operated by the user to control operation of the appliance 1.

On a left-hand side of the user interface 8 an ecometer scale is displayed illustrating degree of ecological impact caused by the selected program, where a full bar indicates a lesser degree of ecological impact, while a short bar indicates a higher degree of ecological impact. Typically, the degree of ecological impact is stipulated by energy and/or water consumption of the washing appliance. That is, the higher the energy and/or water consumption, the greater the ecological impact. As is shown in FIG. 2A, when a user selects a washing program, for instance an Eco program causing a low degree of ecological impact, the ecometer is full and the duration of the program is long, in this example 4 hours.

Thus, with reference to FIG. 3, an estimated duration—4 hours—of a selected washing program is displayed on the user interface 8 in step S101.

Further, a degree of ecological impact—in the form of a full ecometer bar—caused by the selected washing program is displayed in step S102.

Now, in the invention, the user is allowed to operate the user interface 8 to change the duration of the selected washing program in step S103, wherein the washing appliance will adapt the selected cleaning program to comply with the changed duration.

Figure 2B:
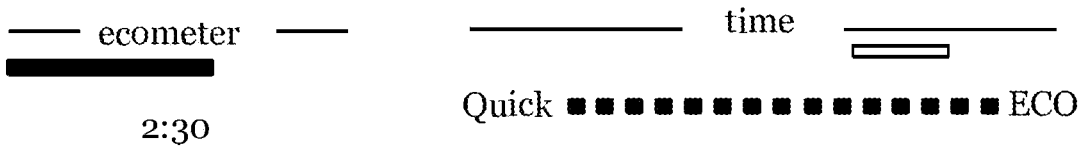

Hence, as is illustrated in FIG. 2B, the user operates the user interface 8 by moving her finger over the touch-screen interface to move the slider 12 to the left, having as an effect that the duration decreases from 4 hours to 2.5 hours. At the same time, the washing appliance adapts to the change in program duration by decreasing the ecometer, thereby indicating that a shorter duration will cause the washing program to have a higher degree of ecological impact, which is displayed to the user in step S104.

As is understood, the slider on the touch-screen could be arranged to have other shapes and forms, such as a circular shape where the user would operate the slider with a circular motion. Again, a mechanical user interface may be envisaged comprising press-buttons and/or revolvable knobs.

For instance, in order to achieve the same degree of cleanness as in the washing program of FIG. 2A, the washing appliance may have to increase the energy consumption—and thus the water temperature—of the washing appliance in order to adapt to the shorter duration of the program of FIG. 2B.

Figure 2C:
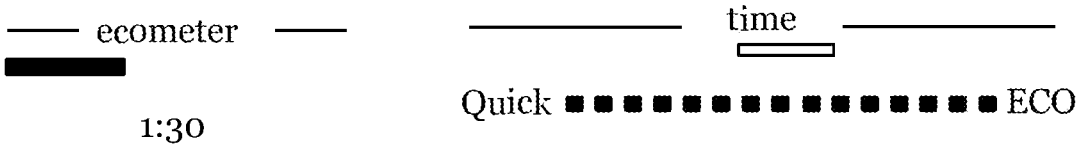

FIG. 2C shows yet an example where the user moves the slider 12 even further left to decrease the duration of the washing program down to 1.5 hours. Conversely, the ecometer decreases and the degree of environmental impact is even higher.

In yet an embodiment, the user is allowed to select a pre-set option to be added to the washing program.

In yet an embodiment, the user interface 8 is equipped with one or more "Options" icons such as "ExtraPower", "ExtraDrying", "Temperature", "Centrifuging", etc., depending on the particular washing appliance.

Further, options such as "ExtraHygiene" for ensuring bacteria-destroying temperatures for sufficiently long time, or "GlassCare" or "Hand Wash" for triggering a particularly lenient washing program, or "Pots&Pans" or "Cotton/Wool/Synthetics" for indicating type of goods washed in the appliance, can be envisaged.

Figure 2D:
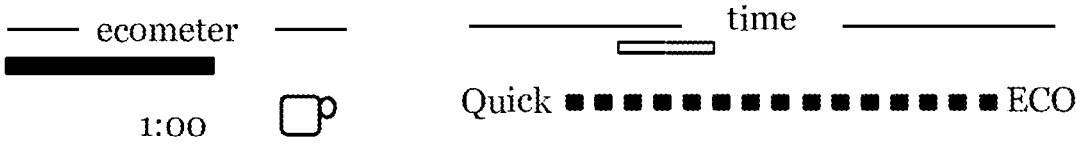

FIG. 2D illustrates user-selection of an option referred to as "NoSoil", the option being illustrated by means of a coffee cup.

Upon the user selecting the "NoSoil" option on the user interface 8, the estimated duration of the washing program with the "NoSoil" option added is displayed to be 1 hour, and even though the washing program is estimated to have a shorter duration than the washing program of FIG. 2C, the ecometer increases thereby indicating a lesser ecological impact.

The reason for this is that the "NoSoil" option is selected when less dirty goods are to be washed, such as e.g. glasses or cups, having as an effect that the washing appliance will use colder water (and hence less energy) to perform the washing program.

Figure 2E:
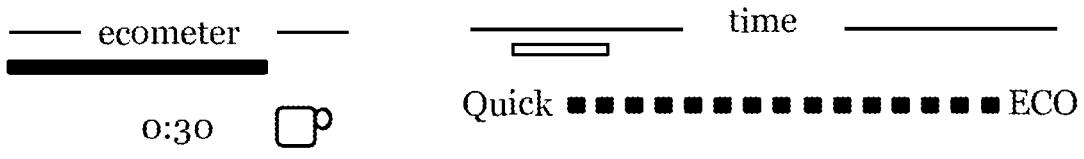

FIG. 2E further illustrates that the user moves the slider 12 in a left-hand direction with the "NoSoil" option selected, thereby decreasing the program duration to 30 minutes. As can be seen, due to the shorter program duration, the degree of ecological impact may decreases. However, this is likely to be achieved at the expense of a lower level of cleanness as compared to the program selection of FIG. 2D. Even though FIGS. 2A through 2E illustrate an ever decreasing program duration, it is noted that one or more programs could be selected where duration indeed is increased by the user.

Figure 4A:
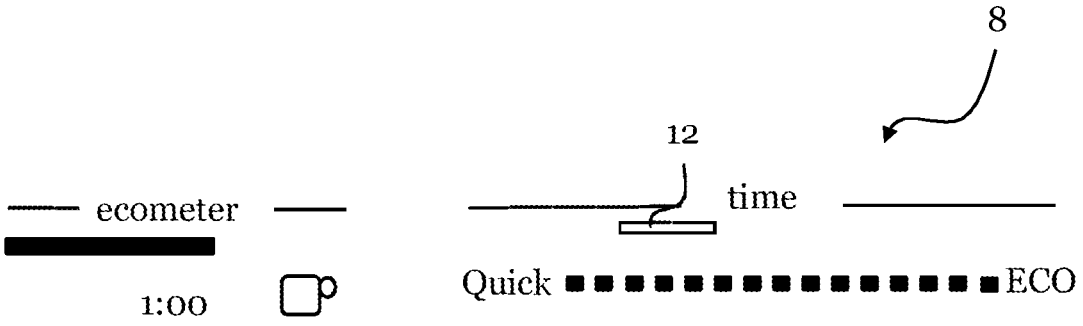
FIGS. 4A and 4B illustrate user interfaces according to another embodiment.
Figure 4B:
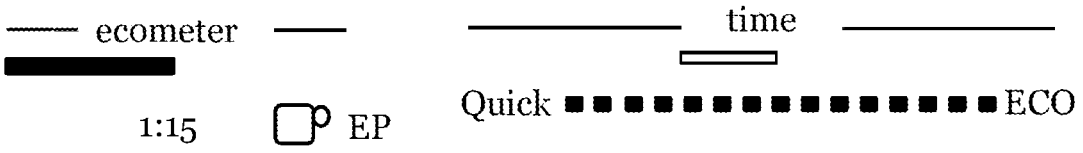

FIGS. 4A and 4B illustrate an embodiment where still another option is added by the user by operating the user interface 8. In this example, an extra power option denoted "EP" is added.

Assuming that in FIG. 4A, the user has selected the program and option "NoSoil" previously shown in FIG. 2D, and further selects the "EP" option on the user interface 8 in FIG. 4B.

This has as an effect that another 15 minutes is added to the program, and since more energy is consumed by the washing appliance, and the ecological impact is greater.

In an embodiment, it is envisaged that the user controls the washing appliance with a wireless communication device such as a smart phone, a tablet, a smart watch, etc. (possibly via an appropriate Application installed on the wireless communication device). Preferably, the wireless communication device is capable of mirroring all or parts of the user interface 8 of the washing appliance on its screen to the user (or at least a representation of the user interface). The user may thus enter any data, which she normally enters via the user interface 8 on the washing appliance 1, on the wireless communication device and send the data to the washing appliance 1 from a remote location.

The washing appliance may be communicatively connected to the wireless communication device via e.g. a wireless telephone network, WiFi or Bluetooth.

Figure 5:
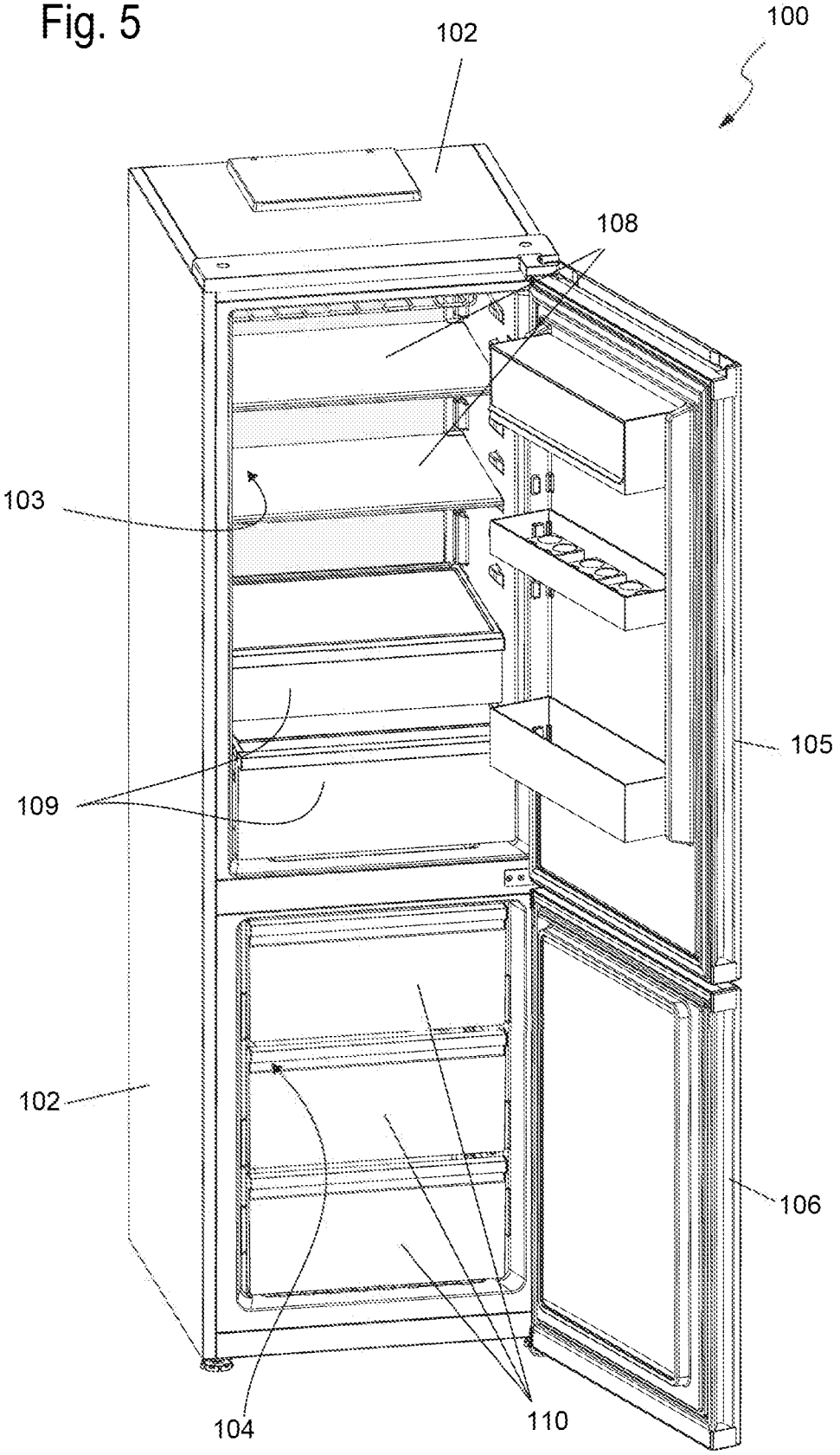
FIG. 5 illustrates a schematic perspective view of a household refrigerator realized in accordance with the teachings of the present invention, with parts removed for clarity's sake.

Starting at FIG. 5, an additional embodiment is described in detail.

Figure 6:
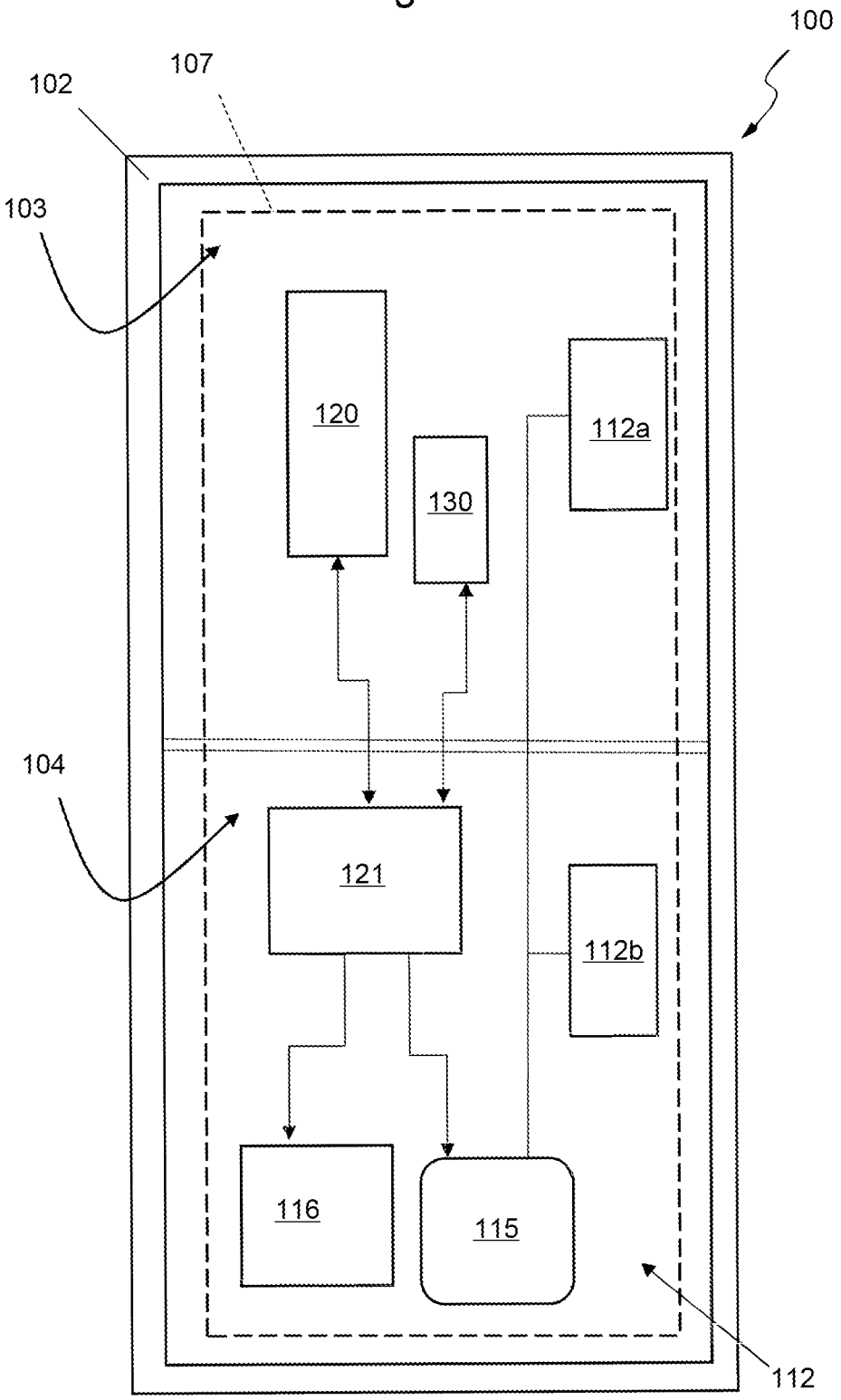
FIG. 6 shows a schematic view of the electronic control system of the refrigerator realized in accordance with the teachings of the present invention.

In FIGS. 5 and 6, 100 denotes as a whole a refrigerator configured to preserve perishable foodstuff and preferably suitable for domestic use, i.e. a household refrigerator.

According to the embodiment illustrated in FIG. 5, the refrigerator 100 comprises a preferably substantially parallelepiped-shaped cabinet 102. The cabinet 102 may be a self-supporting cabinet having a thermal-insulating structure. In the example shown, in particular, the cabinet 102 is preferably structured for stably resting on the floor/ground.

The cabinet 102 is internally provided with at least one, preferably substantially parallelepiped-shaped, thermal-insulated storage cavity. The thermal-insulated storage cavity is designed to accommodate perishable food-stuff. The storage cavity communicates with the outside via a large, preferably roughly rectangular-shaped, access opening which is located on a main face/wall of the same cabinet 102. According to the embodiment illustrated in FIG. 5, the refrigerator 100 further comprises at least one sealing door that has a thermal-insulating structure and is flag hinged to the cabinet 102, so as to be manually rotatable to and from a closing position in which the door abuts on said main face/wall of the cabinet 102 to substantially airtight close the access opening of said storage cavity.

Refrigerator 100 further comprises an electrically-operated cooling system, which is at least partially accommodated inside the cabinet 102, and is structured/adapted to cool down the inside of said inner storage cavity.

Moreover, according to an exemplary embodiment illustrated in FIG. 5, the cabinet 102 is preferably internally provided with two, substantially vertically-aligned, separate and adjacent storage cavities 103 and 104. The storage cavities 103 and 104 are thermal-insulated to one another and to the outside, are both adapted to accommodate perishable foodstuff, and finally communicate with the outside each via a respective large access opening preferably located on the main face/wall of the cabinet 102.

According to the exemplary embodiment illustrated in FIG. 5, the refrigerator 100 furthermore comprises, for each inner storage cavity 103, 104, a respective sealing door 105, 106, which is preferably substantially rectangular in shape, and is preferably flag hinged to the front of the self-supporting cabinet 102 so as to be manually rotatable about a preferably substantially vertically-oriented, reference axis, to and from a closing position in which the door 105, 106 rests/abuts on the front face/wall of cabinet 102 so as to cover and substantially airtight seal the access opening of the corresponding storage cavity 103 or 104. In the example shown in FIG. 1, the storage cavity 103 is arranged above the storage cavity 104.

With reference to FIG. 5, preferably the refrigerator 100 may additionally comprise, inside the storage cavity 103: at least one and preferably a number of nearly horizontally-extending and preferably manually removable, partitioning shelves 108 that are adapted to support perishable foodstuff, and are arranged inside the storage cavity 103 vertically spaced to one another; and optionally also one or more drawer containers 109, which are fitted in manually extractable manner into the storage cavity 103, preferably beneath the partitioning shelve or shelves 108, and are each adapted to accommodate vegetables and similar perishable foodstuff.

Preferably, the refrigerator 100 moreover may comprise at least one and preferably a number of second drawer containers 110 that are fitted in manually extractable manner into the storage cavity 104, preferably vertically-stacked to one another, and are each adapted to accommodate frozen perishable foodstuff. The storage cavity 104 may be a freezing compartment. The storage cavity 103 may be a refrigerating compartment. With reference to FIG. 6, the refrigerator 100 furthermore comprises electrically-operated cooling system 107, which is preferably structured/adapted to separately cool down the inside of storage cavity 103 and preferably additionally or alternatively the inside of storage cavity 104 of the cabinet 102.

The electrically-operated cooling system 107 is preferably designed to cool down the inside of storage cavity 103 so as to keep the inside of storage cavity 103 at a first target temperature and additionally, or alternatively, to cool down the inside of storage cavity 104 so as to keep the inside of storage cavity 104 at a second target temperature, which is preferably lower than the first target temperature. The first target temperature is preferably suitable for short-term preservation of perishable foodstuff inside of the storage cavity 103. The second target temperature is suitable for long-term preservation of perishable foodstuff. For example, the first target temperature is preferably greater than or equal to +0° C., whereas the second target temperature is lower than +0° C. Preferably, the first target temperature ranges between +2° C. and +8° C., whereas the second target temperature ranges between −30° C. and −10° C.

With reference to the exemplary embodiment illustrated in FIG. 6, the electrically-operated cooling system 107 comprises a heat-pump assembly 112. The heat-pump assembly 112 may comprise at least one low-pressure heat exchanger 112*a*, traditionally called evaporator, adapted to cool down the inside of the at least one, thermal-insulated storage cavity 103, 104 of the cabinet 102. Preferably, the heat-pump assembly 112 may be provided with a low-pressure heat exchanger 112*b* or evaporator for each storage cavity 103, 104 of the self-supporting cabinet 102.

The heat-pump assembly 112 may also comprise in addition to evaporators, an electrically-operated compressor 115. The electrically-operated compressor 115 is preferably housed into a specific compressor compartment (not shown) formed on the back of the cabinet 102, and is adapted to compress a low-temperature and low-pressure gaseous-state refrigerant arriving from any one of evaporators for supplying, at outlet/delivery, a flow of high-temperature and high-pressure refrigerant.

With reference to the exemplary embodiment shown in FIG. 6, the electrically-operated cooling system 107 may further be designed to circulate the cold air in closed loop inside the storage cavity 103, and additionally or alternatively also to circulate the cold air in closed loop inside the storage cavity 104. Preferably, the electrically-operated cooling system 107 may also comprise at least an electrically-operated air-blowing device 116. The electrically-operated air-blowing device 116 may be designed to force the cold air to flow/circulate inside the storage cavity 103. The air-blowing device 116 may be an electrically-operated centrifugal fan.

With reference to FIG. 6, the refrigerator 100 may further comprise at least a defrost device 130. The defrost device 130 may comprise one or more electric heaters i.e. electric resistances which are configured to be electrically activated to generate heat to perform the defrost function in the cavity 103 and/or in cavity 104. According to an exemplary embodiment (not illustrated), the defrost device 130 may comprise balancing heaters. Preferably, the defrost device 130 may comprise two balancing heaters associated to the low-pressure heat exchanger 112*a* and respectively the low-pressure heat exchanger 112*b* which are hydraulically connected in series one to the other. The balancing heaters may be electrically controlled in order to regulate the temperature in a storage cavity, i.e. the first temperature in the storage cavity 103, when a high cooling power is provided to the other storage cavity 104, for example the storage cavity 104 by the low-pressure heat exchanger.

With reference to FIG. 6, the refrigerator 100 further comprises a user interface 120, which is configured to allow the user to set at least a control parameter. According to an exemplary embodiment, the user interface 120 is configured to allow the user to set at least a control parameter corresponding to the temperature of at least a storage cavity. For example, the user interface 120 is configured to allow the user to selectively set the temperature of the storage cavity 103 and/or the storage cavity 104. In other words, the user interface 120 is configured to allow the user to regulate/vary the refrigerating temperature in the storage cavity 103 and to regulate/vary the freezing temperature in the storage cavity 104.

The user interface 120 may be also configured to allow the user to select an operating program to be implemented by the refrigerator 100. It is understood that with the term operating program is meant any freezing/cooling function which may be performed by the refrigerator In the following description it will be considered only to increase the understanding of the present invention, but without losing in generality, that the user interface 120 is configured to allow the user to select one or more of the following programs: a standard or default operating program, and/or a program for rapid cooling the cavity 103 hereinafter indicated with Extra-Cool, and/or a program to rapid freezing the cavity 104 hereinafter indicated with Extra-Freez, and/or a program or function for selectively cooling a number of drawer containers 109 hereinafter indicated with Multi-Chill, and/or a defrost function hereinafter indicated with Defrost and/or a defrost balancing function hereinafter indicated with Balancing Defrost.

The user interface 120 may be preferably arranged on a door 105 or 106. For example the user interface 120 may comprise a touch screen interface. It is understood that, in addition or alternately, the user interface 120 may also comprise mechanical interfaces comprising e.g. press-buttons (not illustrated) and revolvable knobs (not illustrated) operated by the user to control operation of the refrigerator 100.

With reference to FIG. 6, the refrigerator 100 further comprises an electronic control system 121, which is configured to control the operation of the refrigerator 100. The electronic control system 121 may comprise electronic/electric control circuits and is electrically connected to the user interface 120 and to the electrically-operated cooling system 109, i.e. the electrically-operated compressor 115 and the air-blowing device 116. The electronic control system 121 is configured to receive from the user interface, the control parameter and/or the program selected by the user. The electronic control system 121 is further configured to control the operation of said electrically-operated cooling system 107 based on the received control parameter and/or the received operating program.

According to the present invention, the electronic control system 121 is further configured to estimate a resource consumption of the electrically-operated cooling system 107 when it operates based on the user setting. The electronic control system 121 is also configured to determine a level or degree of ecological impact caused by the electrically-operated cooling system 107 based on the determined resource consumption. According to the present invention, the degree of ecological impact of the refrigerator is indicative of the energy consumption, e.g. electric power absorbed by at least the electrically-operated cooling system 107 during its operating. For example, it is possible to define a plurality of levels or degrees of ecological impact associated with respective level of consumption of electrical power of the electrically-operated cooling system 107. That is, the higher electrical power absorbed/consumed by the electrically-operated cooling system 107, the greater degree of ecological impact. In other words, the degree of ecological impact is proportional to the electrical power absorbed/consumed by the electrically-operated cooling system 107. Therefore when the consumption of electrical power of the electrically-operated cooling system 107 is low, the degree of the of ecological impact is low. Vice-versa when the consumption of electrical power of the electrically-operated cooling system 107 is high, the degree of the of ecological impact is high. It is understood that the invention may envisage a number of degrees of the ecological impact depending on the levels of consumption of electrical power of the electrically-operated cooling system 107.

According to the present invention, the electronic control system 121 is further configured to communicate the determined degree of ecological impact to the user by means of the user interface 120. The technical effect is that the refrigerator 100 informs, i.e. warns, in real time, the user about the ecological impact caused by his settings.

Figure 7:
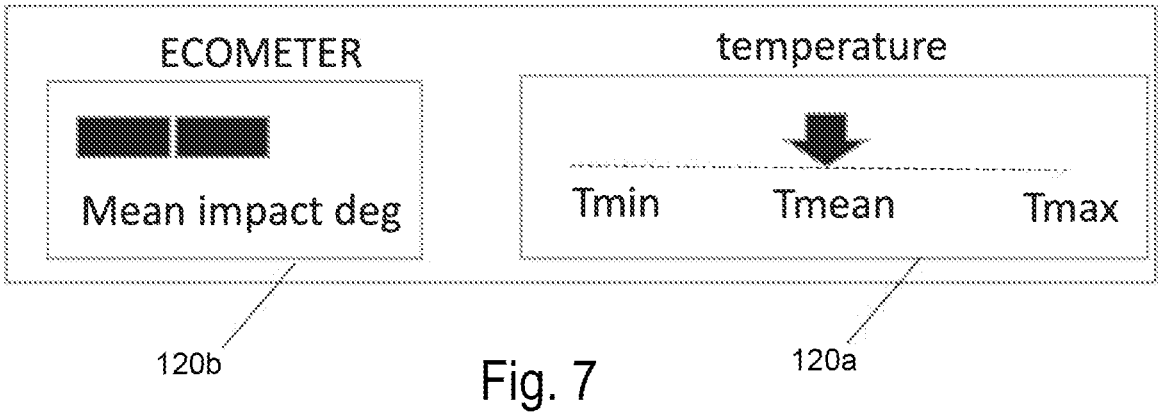
FIGS. 7 to 12 illustrate respective examples of user interfaces of the refrigerator realized according to the present invention.
Figure 8:
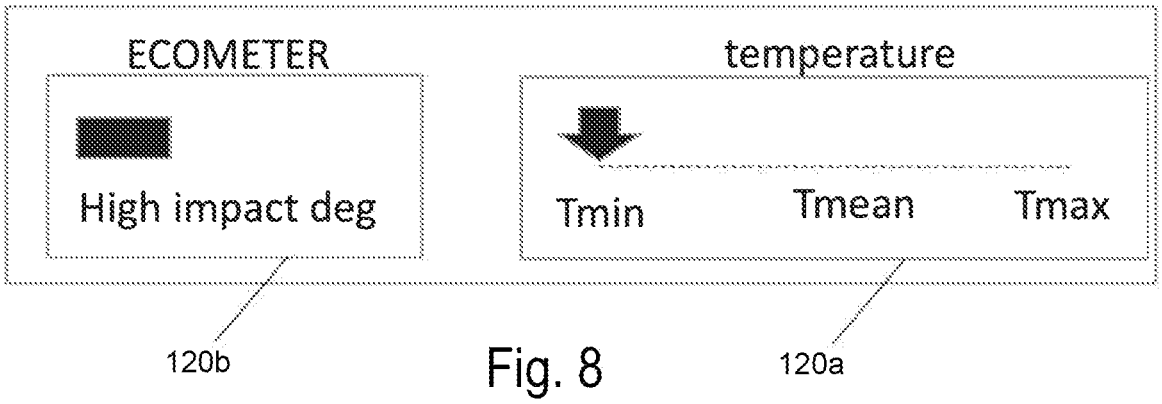
Figure 9:
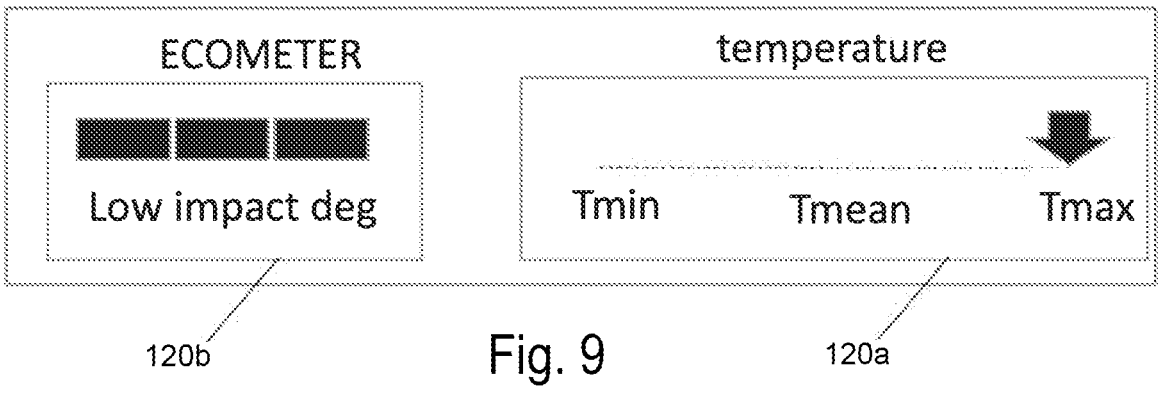

FIGS. 7, 8 and 9 illustrate an exemplary embodiment of the refrigerator 100, wherein the user interface 120 is a touch sensitive screen configured to display a temperature setting device 120*a*, and an ecometer device 120*b*.

As illustrated in an exemplary embodiment schematically shown in Figures from 7 to 9, the temperature setting device 120*a* is configured to allow the user to regulate or vary the temperature in a storage cavity 103 and/or 104, whereas the ecometer device 120*b* displays the degree of ecological impact caused by the regulation of the temperature made by the user.

In the exemplary embodiment illustrated in Figures from 7 to 9, the ecometer device 120*b* displays an ecometer scale. The ecometer scale may comprise a bar formed by a number of segments/portions associated with respective ecological impact degrees. For example, a full bar, e.g. all segments displayed (FIG. 9) may be indicative of the lower impact degree; vice-versa a short bar, e.g. a single segment displayed (FIG. 7) may be indicative of the higher degree of ecological impact.

In the example of FIG. 7, the user sets the temperature at a mean value Tmean, i.e. corresponding to the temperature generated when the refrigerator operates in a normal or default condition/program. In this case, the electrically-operated cooling system 107 operates by absorbing a mean value of electrical power; the electronic control system 121 determines a degree of ecological impact corresponding to a mean impact degree and the ecometer device 120*b* regulates the bar to display a value (by the segments) which is indicative of the determined mean impact degree (two segments). When the user commands a reduction of temperature from the mean value Tmean (FIG. 7) to a minimum temperature Tmin (FIG. 8), the electronic control system 121 estimate an increasing of the consumption of electric power by the electrically-operated cooling system 107. In this case, the electronic control system 121 determines a degree of ecological impact corresponding to a high degree and the ecometer device 120*b* regulates the bar to display a value (by the segments) which is indicative of the determined high impact degree (FIG. 4) (one segment).

When the user commands an increase of temperature to a maximum temperature Tmax, the electronic control system 121 decreases the consumption of electric power. In this case, the electronic control system 121 determines a degree of ecological impact corresponding to a low degree, and the ecometer device 120*b* controls the bar to display a value (by the segments) which is indicative of the determined low impact degree (FIG. 9) (three segments).

Figure 10:
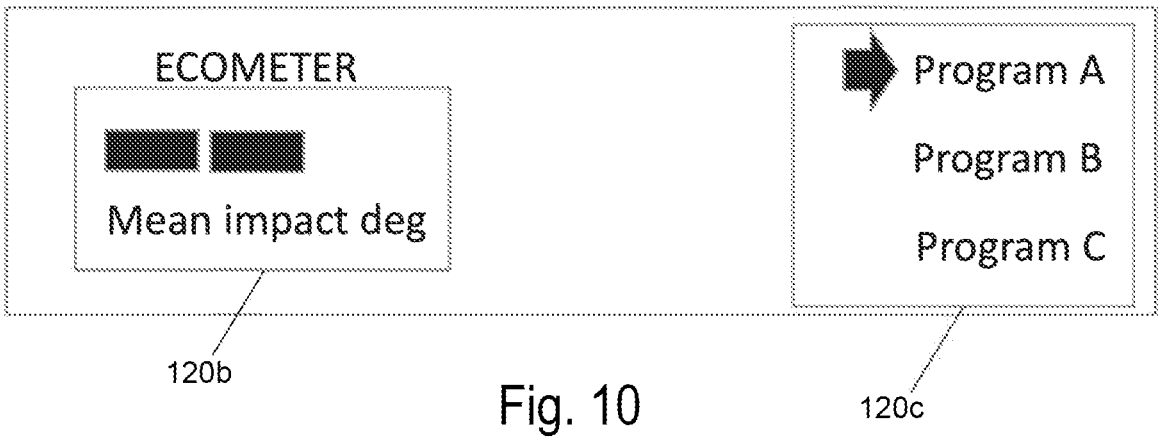
Figure 11:
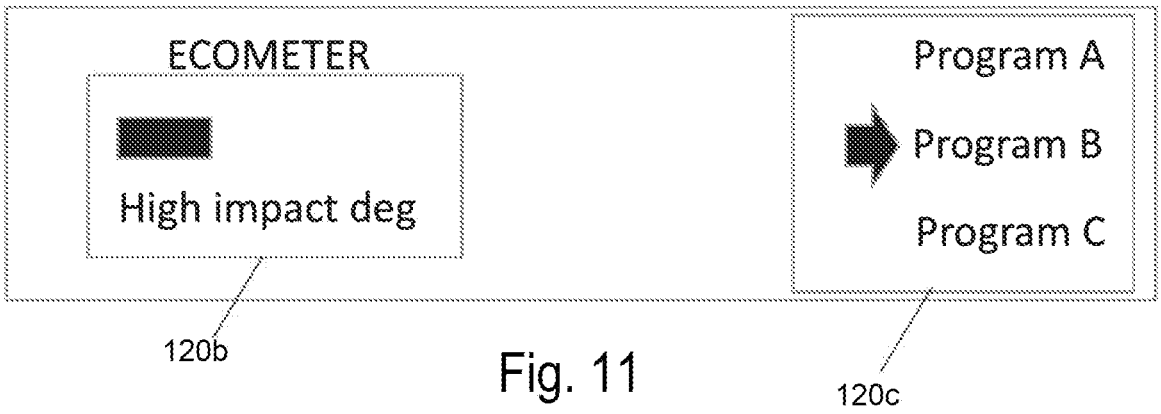
Figure 12:
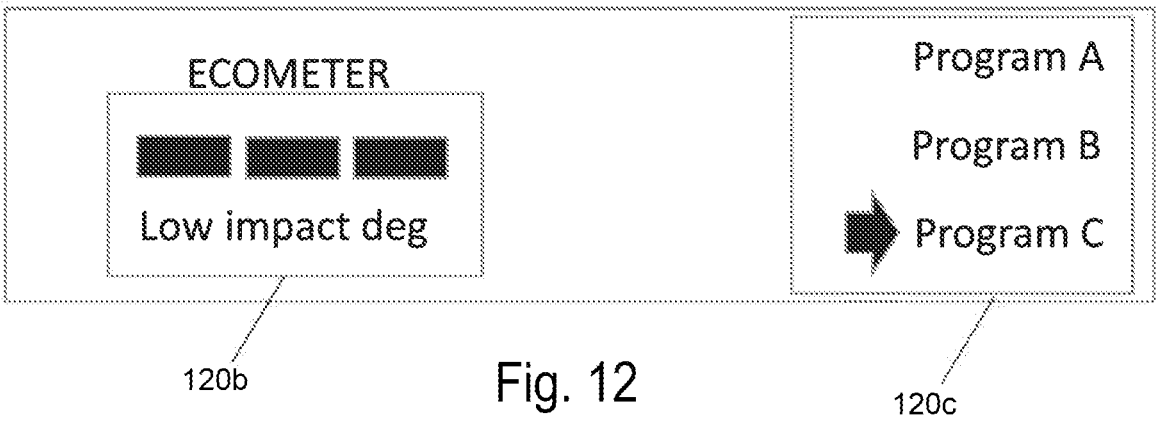

FIGS. 10, 11 and 12 illustrate an exemplary embodiment of the refrigerator 100, wherein the user interface 120 is a touch sensitive screen configured to display a program selecting device 120*c* and the ecometer device 120*b*.

The program selecting device 120*c* may be configured to allow the user to select a program and or a function among a number of prefixed programs/functions. It is understood that each program/functions, when it is implemented by the refrigerator 100, causes the electrically-operated cooling system 107 to consume a respective prefixed electric power.

FIG. 10 shows an example wherein the user select the program A among three programs A, B and C. In the example of FIGS. 6-8, the program A may correspond to a normal or default condition/program. In this case, the electrically-operated cooling system 107 may operate by absorbing a mean value of electrical power. In this condition, the electronic control system 121 may determine a degree of ecological impact corresponding to a mean impact degree and the ecometer device 120*b* regulate the bar to display a value (by the segments) which is indicative of the determined mean impact degree (two segments).

When the user selects another program, e.g. program B (FIG. 11), which causes an increase of the electric power consumed by electrically-operated cooling system 107, the electronic control system 121 determines a degree of ecological impact corresponding to a high degree and the ecometer device 120*b* regulates the bar to display a value (by the segments), which is indicative of the determined high impact degree (FIG. 11) (one segment). The program B may correspond, for example, to: a Extra-Cool program, a Extra-Freez program, a Multi-Chill program, a Defrost program/function, a Balancing Defrost function.

In FIG. 12, the user selects another program, e.g. Program C, which causes a reduction of the electric power consumed by the electrically-operated cooling system 107.

In this condition, the electronic control system 121 determines a degree of ecological impact corresponding to a low degree, and the ecometer device 120*b* regulates the bar to display a value (by the segments), which is indicative of the determined low impact degree (FIG. 12) (three segments). The program C may correspond, for example, to an Eco program configured to cause the electrically-operated cooling system 107 to absorb the lowest electric power.

It is understood that the electronic control system 121 may be configured to estimate the resource consumption based on the electrical consumption of the heat-pump system 112. For example, the electronic control system 121 may be configured to estimate the resource consumption based on: the operating speed and/or the operating time of the electrically-operated compressor which in turn depend on the temperature setting and/or the selected program.

The electronic control system 121 may also be configured to estimate the resource consumption based on the electrical consumption of the electrically-operated air-blowing device 116. For example the electronic control system 121 may be configured to estimate the resource consumption based on: the operating speed and/or the operating time of the electrically-operated air-blowing device 116, which in turn depend on the temperature setting and/or the selected program.

Furthermore, the electronic control system 121 may be configured to estimate the resource consumption based on the electrical consumption of the defrost device 130. For example the electronic control system 121 may measure the current/voltage and or the duty cycle of the electric signals supplied to electric resistors of defrost device 130 during the implementation of the Defrost function.

Figure 13:
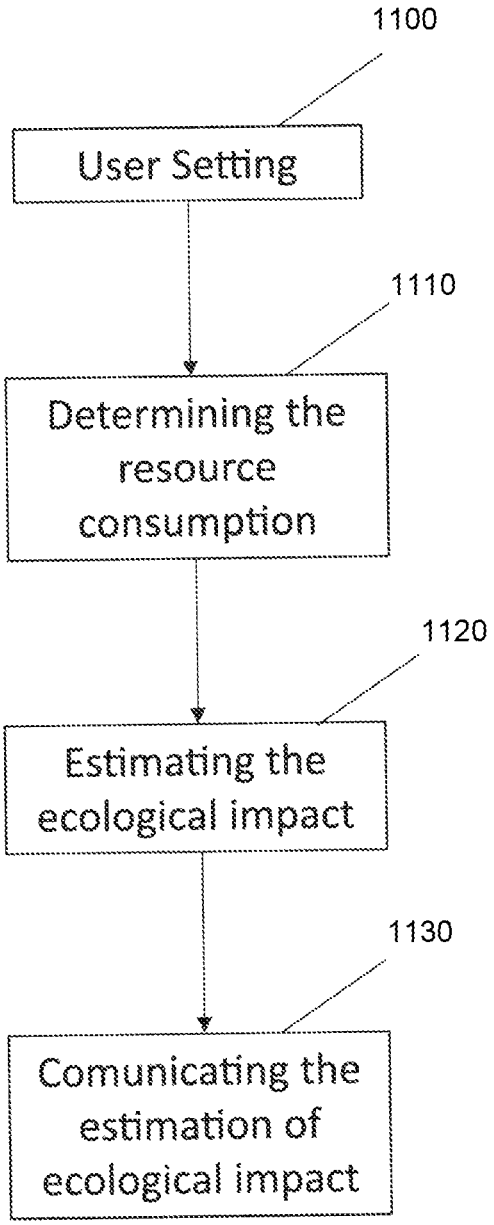
FIG. 13 is a flow chart of another operating method provided according to the present invention.

FIG. 13 illustrates a flow chart of the steps implemented by the method of operating of the refrigerator 100.

The method comprises: allowing the user to operate the user interface 120 to set at least a control parameter and/or select an operating program to be implemented by refrigerator (block 1100). For example in this step, the user interface 120 may display the temperature setting device 120*a* and the program selecting device 120*c* as illustrated in FIGS. 7-12. Moreover the user may regulate the temperature by the temperature setting device 120*a* and/or change the program and/or select a function by the program selecting device 120*c* as illustrated in FIGS. 7-12.

The method comprises estimating by the electronic control system 121 the resource consumption of the electrically-operated cooling system 107 when it operates based on the user setting (block 1110). It is understood that in this step the electronic control system 121 may be configured to estimate the electric consumption of the devices which are activated to reach the operating condition based on the user setting. In other words the electronic control system 121 estimates the electric consumption based on the functioning of the electrically operated compressor 115 and/or the air blowing device 116 and/or the defrost device 130 in response to the user setting.

The method comprises the step of determining by the electronic control system 121 the degree of ecological impact caused by said electrically-operated cooling system 107 based on the determined resource consumption (block 1120). In this step the electronic control system 121 may be configured to determine the degree of ecological impact based on an impact function and/or data stored in an electronic memory of the electronic control system. Data may be stored in the memory according to consume tests made in laboratory in several operating condition of the refrigerator associated with the user setting.

The method comprises the step of communicating the determined degree of ecological impact to the user by means of the user interface (block 1130).

The refrigerator and method described above are advantageous as allow the user to know in real time the ecological consequences that can be determined by his setting of the operation of the refrigerator.

Clearly, changes may be made to the refrigerator without, however, departing from the scope of the present invention.

The invention claimed is:

1. A refrigerator comprising:

a cabinet comprising a thermal-insulating structure having at least one, internal thermal-insulated storage cavity configured to accommodate perishable foodstuff;

a user interface configured to receive a setting selection comprising at least one of a control parameter and/or an operating program to be implemented by the refrigerator;

an electrically-operated cooling system configured to cool down the at least one storage cavity; and an electronic control system configured to:

receive from the user interface the setting selection, control an operation of the electrically-operated cooling system based on the setting selection, estimate a resource consumption at least of the electrically-operated cooling system, when it operates based on the setting selection, determine a degree of ecological impact caused by the electrically-operated cooling system based on the estimated resource consumption, and display the determined degree of ecological impact at the user interface.

2. The refrigerator according to claim 1, wherein:

the user interface is configured to receive an instruction to change a temperature in the storage cavity from a first temperature to at least a second temperature;

the setting selection comprises a change in operating temperature from the first temperature to the second temperature; and the electronic control system is configured to estimate the resource consumption based at least in part on an electrical consumption of the electrically-operated cooling system when operating according to the change in operating temperature from the first temperature to the second temperature.

3. The refrigerator according to claim 1, wherein:

the user interface is configured to receive an instruction to change an operating program from a first program to a second program;

the setting selection comprises a change in the operating program from the first program to the second program; and the electronic control system is configured to estimate the resource consumption based at least in part on an electrical consumption of the electrically-operated cooling system when operating according to the change in the operating program from the first program to the second program.

4. The refrigerator according to claim 1, wherein:

the electrically-operated cooling system comprises an electrically-operated compressor; and the electronic control system is configured to estimate the resource consumption based at least in part on an electrical consumption of the electrically-operated compressor when operating according to the setting selection.

5. The refrigerator according to claim 4, wherein the electronic control system is configured to estimate the electrical consumption of the electrically-operated compressor based on an operating speed and/or an operating time of the electrically-operated compressor when operating according to the setting selection.

6. The refrigerator according to claim 1, wherein:

the electrically-operated cooling system comprises an electrically-operated air-blowing device; and the electronic control system is configured to estimate the resource consumption based at least in part on an electrical consumption of the electrically-operated air-blowing device when operating according to the setting selection.

7. The refrigerator according to claim 1, further comprising a defrost device having one or more electric heaters, wherein the electronic control system is configured to estimate the resource consumption based at least in part on an electrical consumption of the electric heaters of the defrost device when the refrigerator operates according to the setting selection.

8. The refrigerator according to claim 1, wherein:

the user interface comprises a display; and the electronic control system is configured to indicate, on the display, graphic icon-segments which change based on the determined degree of ecological impact.

9. A method of operating a refrigerator comprising a storage cavity, a user interface, an electrically-operated cooling system, and electronic control system, the method comprising:

receiving, at the user interface, a setting selection comprising at least a control parameter and/or an operating program to be implemented by the refrigerator;

operating the electronic control system to control the electrically-operated cooling system to cool down the storage cavity, based on the setting selection;

estimating, by the electronic control system, a resource consumption of at least the electrically-operated cooling system when it operates based on the setting selection;

determining, by the electronic control system, a degree of ecological impact caused by the electrically-operated cooling system based on the estimated resource consumption; and indicating the determined degree of ecological impact at the user interface.

10. The method according to claim 9, wherein:

the setting selection comprises an instruction to change a temperature in the storage cavity from a first temperature to a second temperature; and estimating the resource consumption is based at least in part on an electrical consumption of the electrically-operated cooling system when operating according to the instruction to change the temperature in the storage cavity from the first temperature to the second temperature.

11. The method according to claim 9, wherein:

the setting selection comprises an instruction to change an operating program from a first program to a second program; and estimating by the resource consumption is based at least in part on an electrical consumption of the electrically-operated cooling system when operating according to the instruction to change the operating program from the first program to the second program.

12. The method according to claim 9, wherein the electrically-operated cooling system comprises an electrically-operated compressor, and the step of method comprises estimating the resource consumption comprises, at least in part, estimating an electrical consumption of the electrically-operated compressor when the refrigerator operates according to the setting selection.

13. The method according to claim 12, wherein estimating the electrical consumption of the electrically-operated compressor is based on an operating speed and/or an operating time of the electrically-operated compressor when operating according to the setting selection.

14. The method according to claim 9, wherein the electrically-operated cooling system comprises an electrically-operated air-blowing device, and the method comprises estimating the resource consumption based at least in part on an electrical consumption of the electrically-operated air-blowing device when operating according to the setting selection.

15. The method according to claim 9, wherein the refrigerator comprises a defrost device having one or more electric heaters, and the method comprises estimating the resource consumption based at least in part on an electrical consumption of the electric heaters of the defrost device when the refrigerator operates according to the setting selection.

16. The method according to claim 9, wherein the user interface comprises a display, and the method comprises indicating, on the display, graphic icon-segments which change based on the determined degree of ecological impact.

17. A method of controlling operation of an appliance, comprising:

presenting at a user interface, an option to change an operating program of the appliance;

operating the appliance according to a selected change of the operating program; displaying, on the user interface, an indicator representing the change in the operating program; and displaying, on the user interface, separately from the displayed indicator representing the change in the operating program, a degree of ecological impact caused by the selected change of the operating program, wherein the degree of ecological impact indicates a level of resource consumption used by the appliance to operate according to the selected operating program.

18. The method of claim 17, wherein the option to change the operating program of the appliance comprises an option to change a duration of a washing program from a first duration to a second duration.

19. The method of claim 17, wherein the option to change the operating program of the appliance comprises an option to change an operation of an electrically-operated cooling system from a first program to a second program.

20. A method of controlling operation of an appliance, comprising:

presenting at a user interface, an option to change an operating program of the appliance, wherein the option to change the operating program comprises an option to change an operation of an electrically-operated cooling system from a first program to a second program or an option to change a duration of a washing program from a first duration to a second duration;

operating the appliance according to a selected change of the operating program; displaying, on the user interface, an indicator representing the change in the operating program; and displaying, on the user interface, separately from the displayed indicator representing the change in the operating program, a degree of ecological impact caused by the selected change of the operating program, wherein the degree of ecological impact indicates a level of resource consumption used by the appliance to operate according to the selected operating program.

* * * * *